US005806120A

United States Patent [19]

McEachern

[11] Patent Number: 5,806,120

[45] Date of Patent: Sep. 15, 1998

[54] OZONATED LAUNDRY SYSTEM

[75] Inventor: Dennis H. McEachern, Concord, N.C.

[73] Assignee: Envirocleanse Systems, Inc., Mooresville, N.C.

[21] Appl. No.: 866,520

[22] Filed: May 30, 1997

[51] Int. Cl.[6] ..... D06F 33/02; D06F 39/08

[52] U.S. Cl. ..... 8/158; 68/12.01; 68/12.12; 68/13 R; 68/18 F; 68/207

[58] Field of Search ..... 8/158; 68/12.01, 68/12.12, 12.18, 13 R, 18 R, 183, 207

[56] References Cited

U.S. PATENT DOCUMENTS

| | | | |
|---|---|---|---|
| 5,097,556 | 3/1992 | Engel | 8/158 |
| 5,181,399 | 1/1993 | Engel | 68/13 R |
| 5,241,720 | 9/1993 | Engel | 8/158 |
| 5,493,743 | 2/1996 | Schneider | 8/149.2 |
| 5,625,915 | 5/1997 | Radler et al. | 68/12.12 X |

*Primary Examiner*—Philip R. Coe

*Attorney, Agent, or Firm*—Dougherty & Dremann

[57] ABSTRACT

A system for treating laundry with ozone including a controller that receives a load signal based on a wash load selection. The controller varies an output potential from a variable power supply to an ozone generator in response to the load signal. The ozone generator produces different levels of ozone corresponding to the output potential. A wash liquor is drawn out of a laundry machine and sent through a filter past an injector adjacent a venturi. The injector entrains ozone from the ozone generator into the wash liquor and the wash liquor is returned to the laundry machine. A method is disclosed for treating laundry with ozone by: selecting a wash load selection from a plurality of wash load selections; varying the amount of ozone provided to the injector by an ozone generator in response to the load selection; drawing a wash liquor from the laundry machine by a pump; filtering the wash liquor from the laundry machine through a filter; entraining ozone from the ozone generator into the wash liquor; and returning the wash liquor to the laundry machine.

20 Claims, 6 Drawing Sheets

LAUNDRY MACHINE
22
28
CONTROLLER
42
PROCESS PUMP
WASH LOAD SELECTION
36
DRYER
32
POWER SUPPLY
34
OZONATOR

Fig. 5

| 90 STEP NUMBER | 92 NAME | 94 WATER | | 96 WATER LEVEL | 98 MIN. | 100 CHEM NUM. |
|---|---|---|---|---|---|---|
| | | HOT | COLD | | | |
| 1 | BREAK/BLEACH | ✓ | ✓ | 3 | 11 | 1,2,3 |
| | DRAIN | | | | 1 | |
| 2 | INTERMEDIATE EXTRACTION | | | | 1 | |
| 3 | RINSE | ✓ | ✓ | 3 | 2 | |
| | DRAIN | | | | 1 | |
| 4 | INTERMEDIATE EXTRACTION | | | | 1 | |
| 5 | RINSE/SOUR | | ✓ | 3 | 4 | 4 |
| | DRAIN | | | | 1 | |
| 6 | FINAL EXTRACTION | | | | 8 | |
| 7 | END | | | | | |

OZONATED LAUNDRY SYSTEM

FIELD OF THE INVENTION

The invention relates generally to a system and method for treating laundry with ozone, and more particularly, to a system and method for treating laundry with ozone including means for varying the concentration of the ozone in the wash liquor in response to the wash load.

BACKGROUND OF THE INVENTION

The utilization of activated oxygen, or ozone, to clean, disinfect and deodorize is well known. For many years, water treatment plants have positioned ozone generators in the waste water, or effluent, stream to entrain ozone into the effluent. The ozone kills bacteria and inactivates many viruses, fungi and other pathogens present in the effluent. More recently, producers of bottled water have incorporated entrained ozone in the purification process to kill germs and bacteria that might be in water to be bottled. Ozone is created when oxygen comes in contact with either ultraviolet light or electricity. The ultraviolet light or electricity breaks up some of the oxygen molecules consisting of a pair of single oxygen atoms into numerous single oxygen atoms, a portion of which reassemble to form ozone ($O_3$) molecules. The ozone molecules have very high oxidation capabilities, and thus, readily react with metals to form oxides, such as $FeO_2$ and $CrO_2$.

It is also well known to treat laundry with ozone. U.S. Pat. No. 5,097,556 issued Mar. 24, 1992 to Engle et al.; U.S. Pat. No. 5,181,399 issued Jan. 26, 1993 to Engle et al.; U.S. Pat. No. 5,241,720 issued Sep. 7, 1993 to Engle et al.; and U.S. Pat. No. 5,493,743 issued Feb. 27, 1996 to Schneider et al., all disclose methods and apparatus for utilizing ozone in the laundry wash process to treat laundry waste water.

The use of ozone in the laundry wash process produces a number of significant environmental benefits and cost savings. For example, when ozone is generated and entrained into the wash liquor during the wash cycle, the activated oxygen attacks the larger soil molecules and fragments them into smaller ones so that the wash chemistry (e.g., detergents, bleaches and additives) is more effective in removing the soil from the laundry items. The smaller soil molecules are more easily acted on by the wash chemistry. Thus, a greater percentage of the soil embedded in the laundry items dissolves into the wash liquor for removal with the laundry waste water. In addition, the ozone acts as a powerful disinfecting and cleansing additive due to its oxidizing capabilities. The strong oxidizing capabilities of ozone allow for inactivation of contaminants such as viruses and other pathogens.

Because of the increased effectiveness of the wash chemistry and the oxidizing capabilities of the ozone, the concentration of the wash chemistry in the wash liquor can be substantially reduced. In some applications, the wash chemistry can even be eliminated entirely. Accordingly, less chemicals that are harmful to the environment are required to be used and subsequently discharged into the ground or municipal sewer system. The increased effectiveness of the wash chemistry shortens the wash cycle time of the laundry, and thus reduces the energy used by the laundry. The rinse cycle time is also reduced because less chemicals must be rinsed from the laundry items. Likewise, the number of rinse cycles can also be reduced. Thus, the amount of water needed to rinse the wash chemistry from the laundry is reduced. An added benefit of the reduced concentration of wash chemistry, cycle time and number of cycles is that the useful life of the laundry items washed in an ozonated laundry system is increased.

With fewer chemicals present in the wash liquor, the waste water from the laundry process is less harmful to the environment, and is easier and less costly to cleanse. Sewage costs have risen dramatically in recent years in response to ever increasing water purification standards. The stricter municipal water purification standards require waste water, especially from commercial and industrial sources, to be thoroughly cleansed before the water is returned to the municipal water supply. In some instances, ozone can be utilized in a closed loop laundry system to treat the laundry waste water after filtration. The filtered and ozone-treated water is then recycled back to the wash liquor for further use by the laundry. Accordingly, additional cost savings and environmental benefits are obtained.

For example, ozone has been applied to closed-loop laundry systems (FIG. 1*a*) which recycle the water used during each cycle of the wash load. Water is supplied from a municipal water source to a storage tank 10 in a conventional manner. The water is used for the laundry wash process and for refilling the storage tank 10 when the water level in the tank is low. Ozone generated by an ozone generator 12 is entrained into the water, for example, by pumps or injectors located in the storage tank 10. A laundry machine 14 is filled with the ozonated water at the start of the laundry wash process. During a drain cycle of the laundry machine 14, the wash liquor is drained through filter 16 to collect particulate waste. One or more filters or filter screens can be used to progressively eliminate smaller particles without impeding the flow of the wash liquor. The filtered wash liquor is then returned to the storage tank 10, thereby closing a laundry treatment loop 20. After the laundry wash process has completed a final drain cycle, the treated waste water can be diverted to the sewer 18, or returned to the storage tank 10 for reuse.

Ozone has also been applied to open-loop laundry systems (see FIG. 1*b*) in which the laundry waste water is drained after each wash cycle and after each rinse cycle of the laundry wash process. Water is supplied from a municipal water source to a storage tank 10 in a conventional manner. The water is used for the laundry wash process and for refilling the storage tank 10 when the water level in the tank is low. Ozone generated by an ozone generator 12 is entrained into the water, for example, by pumps or injectors located in the storage tank 10. One or more tanks for storing and holding water may be used in the laundry wash process in conjunction with one or more laundry machines. A laundry machine 14 is filled with the ozonated water at the start of the laundry wash process. During a drain cycle of the laundry machine 14, the wash liquor is drained through filter 16 to collect particulate waste. At the end of each cycle of the laundry wash process, the wash liquor is filtered and drained to the sewer line 18 for further waste water treatment before rejoining the municipal water supply.

Unfortunately, utilization of ozone with laundry typically produces off-gases because the concentration of ozone supplied to the laundry wash process is maintained at a constant level regardless of the size or content of the particular wash load. In commercial automated laundry facilities, various sizes of wash loads and various laundry items are washed. However, the concentration of ozone used in each laundry wash process is maintained at a constant level. Once the ozone is entrained into the wash liquor, the ozonated wash liquor is provided to the laundry machine, where agitation of the ozonated wash liquor by the laundry machine causes the excess ozone to off-gas. With wash loads of varying size and content in commercial applications, different amounts of off-gasing are produced when a constant level of ozone is generated and entrained into the wash liquor.

In known conventional commercial laundry facilities, the wash chemistry introduced to the wash liquor can be reduced because of the addition of ozone. However, current laundry systems and methods of cleaning laundry using ozone do not adequately address the need for further reduction of the wash chemistry in response to varying wash loads. Despite the benefits of using ozone in the laundry wash process, a more efficient use of the wash chemistry and further reductions in energy and water consumption are possible. The additional benefits of using less wash chemistry and consuming less energy and water for washing and rinsing laundry are substantial, especially in commercial laundry facilities that wash large quantities of laundry.

Accordingly, it is apparent that a system and method for treating laundry with ozone is needed that varies the concentration of the ozone entrained in the wash liquor in response to the wash load. Further needed is a system and method for treating laundry with ozone that varies the concentration of the ozone entrained in the wash liquor in response to the particular wash cycle of the wash load. Further needed is a system and method for treating laundry with ozone that determines and introduces an efficient amount of ozone and wash chemistry into the wash liquor in response to varying wash loads to minimize ozone off-gasing to use less wash chemistry, and to reduce the amount of energy and water needed to wash and rinse the laundry.

OBJECTS OF THE INVENTION

The principle object of the invention is to provide a system and method for treating laundry with ozone that varies the concentration of the ozone in the wash liquor.

Another, more particular, object of the invention is to provide a system and method for treating laundry with ozone that varies the concentration of the ozone entrained in the wash liquor in response to the wash load.

Another, more particular, object of the invention is to provide a system and method for treating laundry with ozone that varies the concentration of the ozone entrained in the wash liquor in response to a particular cycle of the laundry wash process.

Another, more particular, object of the invention is to provide a system and method for treating laundry with ozone that balances the concentration of the ozone entrained in the wash liquor with the wash chemistry in response to the wash load.

Another, more particular, object of the invention is to provide a system and method for treating laundry with ozone that determines and introduces an efficient amount of ozone and wash chemistry into the wash liquor in response to varying wash loads to minimize ozone off-gasing.

Another object of the invention is to provide a system and method for treating laundry with ozone that reduces the amount of energy and water needed to wash and rinse the laundry.

SUMMARY OF THE INVENTION

The present invention is a system and method for treating laundry with ozone that varies the concentration of ozone entrained in the wash liquor. A user selects a pre-determined wash formula corresponding to the wash load. In response to the pre-determined wash formula, a controller sends a control signal to a power supply in electrical communication with the controller. The power supply produces a variable electrical output potential in response to the control signal that is in turn provided to an ozone generator in electrical communication with the power supply. At the same time, an air dryer activated by the controller supplies desiccated air to the ozone generator. Accordingly, the ozone generator generates a variable amount of ozone corresponding to the electrical output potential received from the power supply. Meanwhile, the wash liquor is drawn from the laundry machine through a particulate filter positioned in a liquid conduit and to a venturi adjacent an ozone injector by a pumping means activated by the controller. The injector receives ozone from the ozone generator and injects the ozone into the wash liquor at the venturi so that the ozone is entrained into the wash liquor. The amount of ozone produced by the ozone generator varies with the wash load and is balanced with the wash chemistry of the pre-determined wash formula in the wash liquor. The ozonated wash liquor is then returned to the laundry machine for use in the laundry wash process.

A preferred method according to the invention includes the steps of: (1) selecting a pre-determined wash formula that corresponds to a particular wash load; (2) providing a load signal from the laundry machine to the controller based on the pre-determined wash formula; (3) varying the amount of ozone provided to an injector by an ozone generator in response to a control signal received from the controller that corresponds to the load signal; (4) drawing the wash liquor from the laundry machine through a particulate filter positioned in a liquid conduit and to a venturi adjacent an ozone injector using a pumping means activated by the controller; (5) entraining ozone from the injector into the wash liquor at the venturi; and (6) returning the ozonated wash liquor to the laundry machine. Accordingly, the concentration of the ozone entrained into the wash liquor is controlled by the controller in response to the pre-determined wash formula for the particular pre-selected wash load, and the wash chemistry is balanced with the ozone entrained in the wash liquor so that optimal cleansing, environmental benefits and cost-effectiveness are achieved by the laundry wash process. By controlling the ozone concentration entrained in the wash liquor and balancing the wash chemistry of the wash liquor with the ozone concentration, the present invention reduces the amount of water, detergents (including bleaches, surfactants, disinfectants and additives) and energy used in the laundry wash process.

BRIEF DESCRIPTION OF THE DRAWINGS

The foregoing objects of the invention, as well as others, will become more readily apparent by referring to the following detailed description and the appended drawings in which:

FIG. 5 is a table illustrating a pre-determined wash formula for treating laundry with ozone in accordance with the present invention.

DETAILED DESCRIPTION

While the invention is described herein in the context of an open-loop laundry system with side-arm recirculation, the present invention is not intended to be limited to open-loop laundry systems and is equally applicable to closed-loop laundry systems. Furthermore, while the invention is described with respect to a single laundry machine for convenience of explanation, the present invention is not intended to be limited to such and is equally applicable to a laundry system having more than one laundry machine.

Figure 1A:
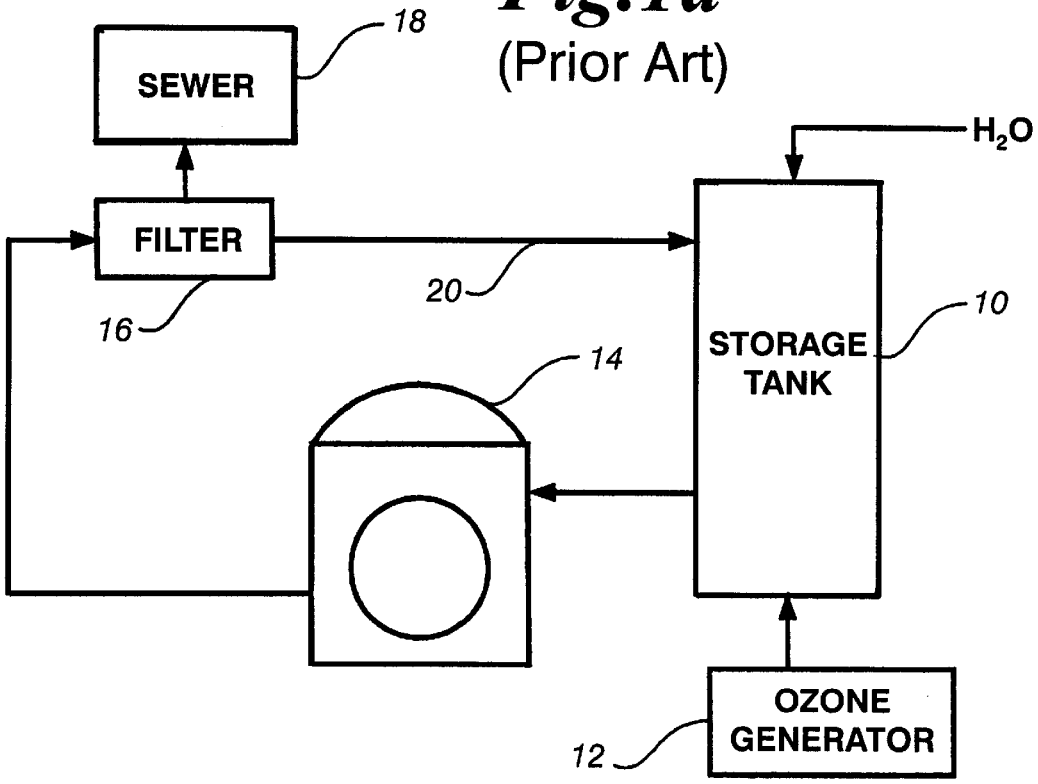
Fig.1a (Prior Art)
FIG. 1*a* is a schematic diagram of a closed-loop, ozonated laundry system illustrating the state of the art.
Figure 1B:
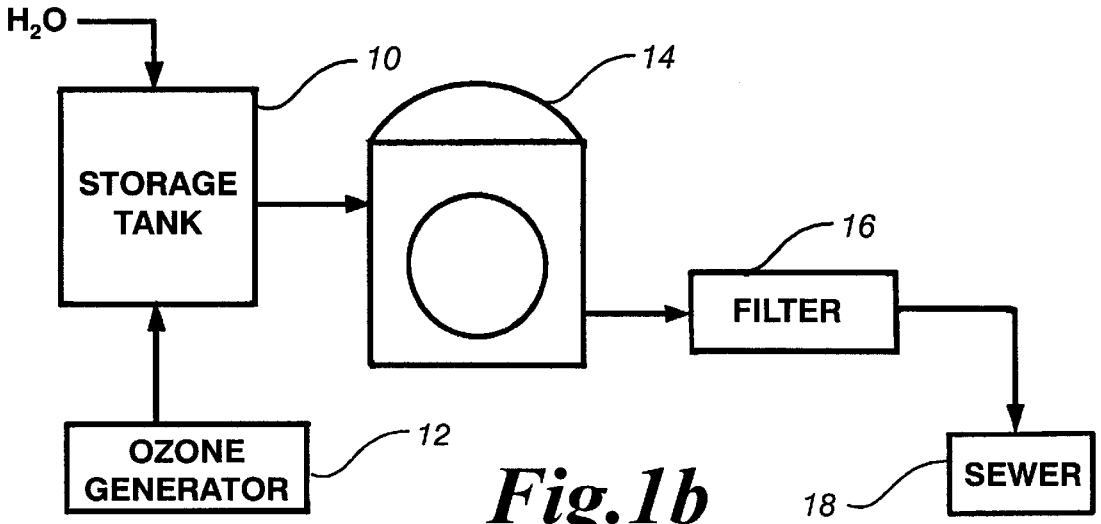
Fig.1b (Prior Art)
FIG. 1*b* is a schematic diagram of an open-loop, ozonated laundry system illustrating the state of the art.
Figure 2:
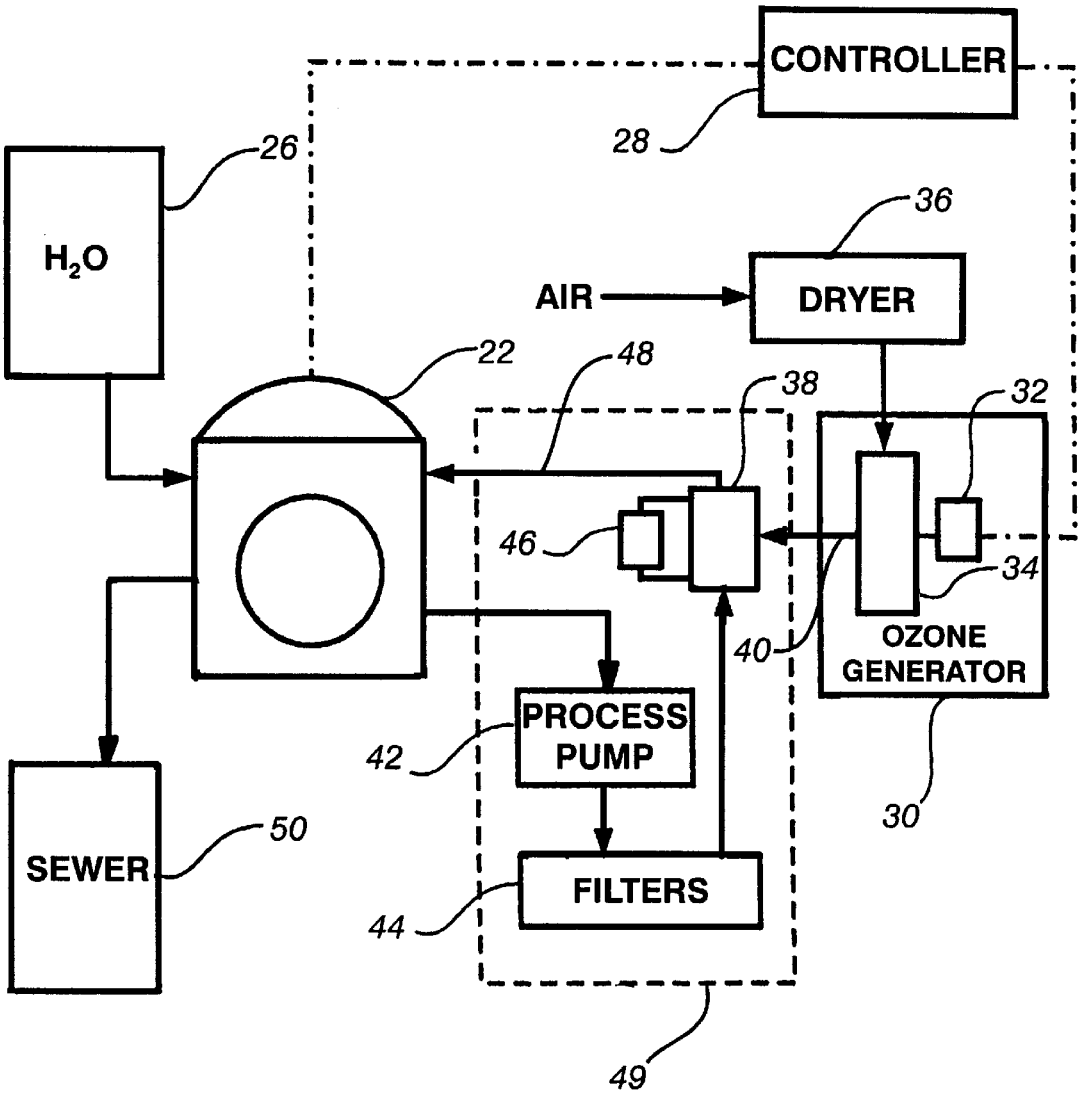
FIG. 2 is a schematic diagram of an improved ozonated laundry system in accordance with the present invention.

FIG. 2 is a simplified schematic diagram of an improved ozonated laundry system in accordance with the present invention. The laundry system includes a laundry machine 22 which is preferably of the type found in a commercial laundry installation, such as a laundromat, hotel, school, dormitory or other establishment in which a large quantity of laundry is washed. However, the laundry machine 22 may also be a conventional washing machine of the type found in private residences, and may be equipped with an automated detergent dispenser of otherwise adapted to accept a wash formula from a controller. The laundry machine 22 performs a laundry wash process consisting of various cycles. The various cycles typically include a fill, a break (i.e., agitation), a wash, a rinse, a drain and an extraction cycle. The laundry wash process begins when the laundry machine 22 is activated by a user and ends when a final extraction of the wash liquor is complete. The laundry machine 22 has a selector means for selecting a wash load from a plurality of pre-determined wash load selections. The wash load selections are based on the type of laundry (i.e., the size, content and articles) to be washed. For example, the wash load may be selected from the group consisting of light, medium and heavy. However, other, more specific wash load selections can be included in the selection group.

The wash load selection will determine the wash formula for the laundry, and thus, the water temperatures and levels, the wash chemistry, the various cycles and ultimately, the ozone concentration in the wash liquor. At the beginning of a wash or rinse cycle in the laundry wash process, hot and/or cold water, depending on the wash load selection, enters the laundry machine 22 through a water source line 24 from a municipal water source 26.

When the wash load selection is chosen, a wash formula corresponding to the load selection is selected and provided to a controller 28. Each wash load selection preferably has a corresponding wash formula. The wash formula is in a machine readable format such as a coded card or film that electronically determines the specific control signals to be transmitted by the controller 28. The wash formula signals indicate in real time an input of hot/cold water, an amount of each wash additive (e.g., detergent, disinfectant and surfactant) to produce a pre-determined wash chemistry, and a number and a duration of each type of cycle to be used for the particular wash load selection. Thus, each load selection determines the wash chemistry, the water level and temperature and the cycles for the particular wash load selection.

A conventional wash additive dispenser (not shown) attached to the laundry machine 22 dispenses the different wash additives into the wash liquor in response to the wash formula. The dispenser comprises a microprocessor electrically communicating with the laundry machine 22 and the controller 28, a plurality of wash additive containers and a dispensing pump connected to the plurality of containers. When the wash formula indicates that a specific wash additive is to be dispensed into the wash liquor, the microprocessor receives a dispensing signal from the controller 28. Based on the dispensing signal, the microprocessor determines the specific wash additive and the volume of each wash additive to be dispensed. The microprocessor then activates the dispensing pump to introduce the specific wash additive into the wash liquor in the laundry machine 22.

The controller 28 is electrically connected to the laundry machine 22 and determines the load signal from the wash formula. The load signal indicates to the controller 28 the particular control signal to transmit. The controller 28 transmits a control signal that corresponds to the wash load selection to an ozone generator 30. In an alternative embodiment of the present invention, the controller 28 selects a control signal from a programmable data input means stored in a storage medium (e.g., random access memory, other semiconductor or magnetic read-write memory devices, magnetic tape, floppy disk, hard disk) provided on the controller 28 that corresponds to the load signal and then transmits the control signal to the ozone generator.

The ozone generator 30 has a power supply 32 electrically connected to an ozonator 34. The power supply 32 is adapted to receive the control signal from the controller 28 and is preferably variable (e.g., a high voltage, high frequency variable source coupled with load capacitance). Power is varied, for example by a rheostat and/or by varying the load capacitance coupled to the power supply 32. Upon receiving the control signal from the controller 28, the power supply 32 varies an output potential in response to the control signal. The output potential is preferably varied from about 0 to about 220 volts AC. In a preferred embodiment of the present invention, the output potential is varied by changing the coupling capacitance. This minimizes production of heat in the power supply 32 in comparison to varying the amplitude, because varying the amplitude of the output potential increases resistance and produces heat. Thus, changing the coupling capacitance minimizes the production of heat and prolongs the service life of the electronics involved with the power supply 32.

The output potential is transmitted to the ozonator 34. The ozonator 34 produces different concentrations of ozone in response to the output potential received from the power supply 32. The power supply 32 can also be located outside of the ozone generator 30.

During ozone production, the controller 28 activates an air dryer 36. Ambient air enters the dryer 36 where the air is desiccated so as to have a dew point temperature of from about −80° F. to about −100° F. The dryer 36 is connected to the ozone generator by an air shaft. The ozone generator 30 generates ozone by passing the dry air received from the dryer 36 through a discharge field. Part of the air is transformed into charged oxygen ions that recombine to form $O_3$, or ozone. The ozone generated by generator 30 is passed to an injector 38 through an ozone feed line 40.

During the wash process, wash liquor is drawn out of the laundry machine 22 by a process pump 42 and passed through a filter 44 when the wash formula indicates to the controller 28 to activate the pump 42. The pump 42 connects the laundry machine 22 and the filter 44 to draw the wash liquor out of the laundry machine 22 through a side arm recirculation system to be described hereafter. One or more filters may also be used to remove particulates out of the wash liquor. The wash liquor is drawn past the injector 38 where the ozone is entrained into the wash liquor as it is produced by the ozone generator 30. A flow valve 46 is connected to the injector 38 to regulate the flow rate of the wash liquor past the injector 38. The wash liquor is returned to the laundry machine 22 along a wash liquor return conduit 48, completing the side arm recirculation system 49 of the open-loop laundry system. The wash liquor return conduit 48 has a length of between about 10 feet to about 20 feet, and is preferably between about 12 feet to about 15 feet in length. The flow rate of the wash liquor is preferably held constant and the generated ozone produces a pre-determined ozone concentration entrained in the wash liquor corresponding to the wash load selection. During ozone production, the controller 28 activates the pump 42, the injector 38 and the dryer 36 while signalling the power supply 32 to send a particular output potential to the ozonator 34 in response to the wash formula. Accordingly, the ozone concentration entrained in the wash liquor is regulated by the controller 28.

The flow valve 46 connected to the injector 38 can increase or decrease the flow rate of the ozonated wash liquor. Changing the flow rate changes the amount of ozone entrained into the wash liquor. The flow rate of ozonated wash liquor is preferably maintained at 10 standard cubic feet per hour (SCFH). By maintaining a constant flow rate and producing a known amount of ozone, a pre-determined ozone concentration is entrained into the wash liquor that is appropriate for each particular wash load selection. In an alternative embodiment, the ozone entrained in the wash liquor is controlled by varying the flow rate with the flow valve 46.

In a preferred embodiment of the present invention, the pre-determined wash chemistry of the wash liquor is balanced with the ozone entrained into the wash liquor. As previously described, a pre-determined amount of each wash additive (e.g., detergent, disinfectant and surfactant) is added to the laundry machine in response to the wash load selection and corresponding wash formula. Each wash load selection corresponds to a pre-determined amount of wash additive that is to be balanced with a pre-determined amount of ozone to be entrained into the wash liquor. In operation, the ozone-enhanced chemistry of the detergents, surfactants, disinfectants and other wash additives minimizes or eliminates ozone off-gasing, conserves water consumption and requires less energy to heat the water.

By properly balancing the ozone concentration entrained in the wash liquor with the wash load type, the ozone is completely utilized and off-gasing of ozone into the atmosphere is eliminated. A reduction in wash additive of as much as 50% is possible when varying the ozone concentration entrained in the wash liquor in accordance with the load type. In addition, the rinse cycles of the laundry wash process can be reduced in time, or eliminated altogether thereby conserving water and reducing costs associated with the wash process. Using ozone reduces hot water use by allowing the use of 100° F. water instead of 140–160° F. water to accomplish the same level of cleaning and disinfection.

In a preferred embodiment of the present invention, wash liquor from the laundry machine 22 is drained after each wash, rinse and extraction cycle to a municipal sewage system 50 thereby establishing the open-loop laundry system. In an alternative embodiment of the present invention, the wash liquor from the laundry machine 22 is recycled after each wash cycle until the laundry treatment process reaches the final rinse cycle where the wash liquor is then drained to the sewage system 50. The filter located between the pump 42 or the injector 38 can be removed or disconnected for cleaning.

Figure 3A:
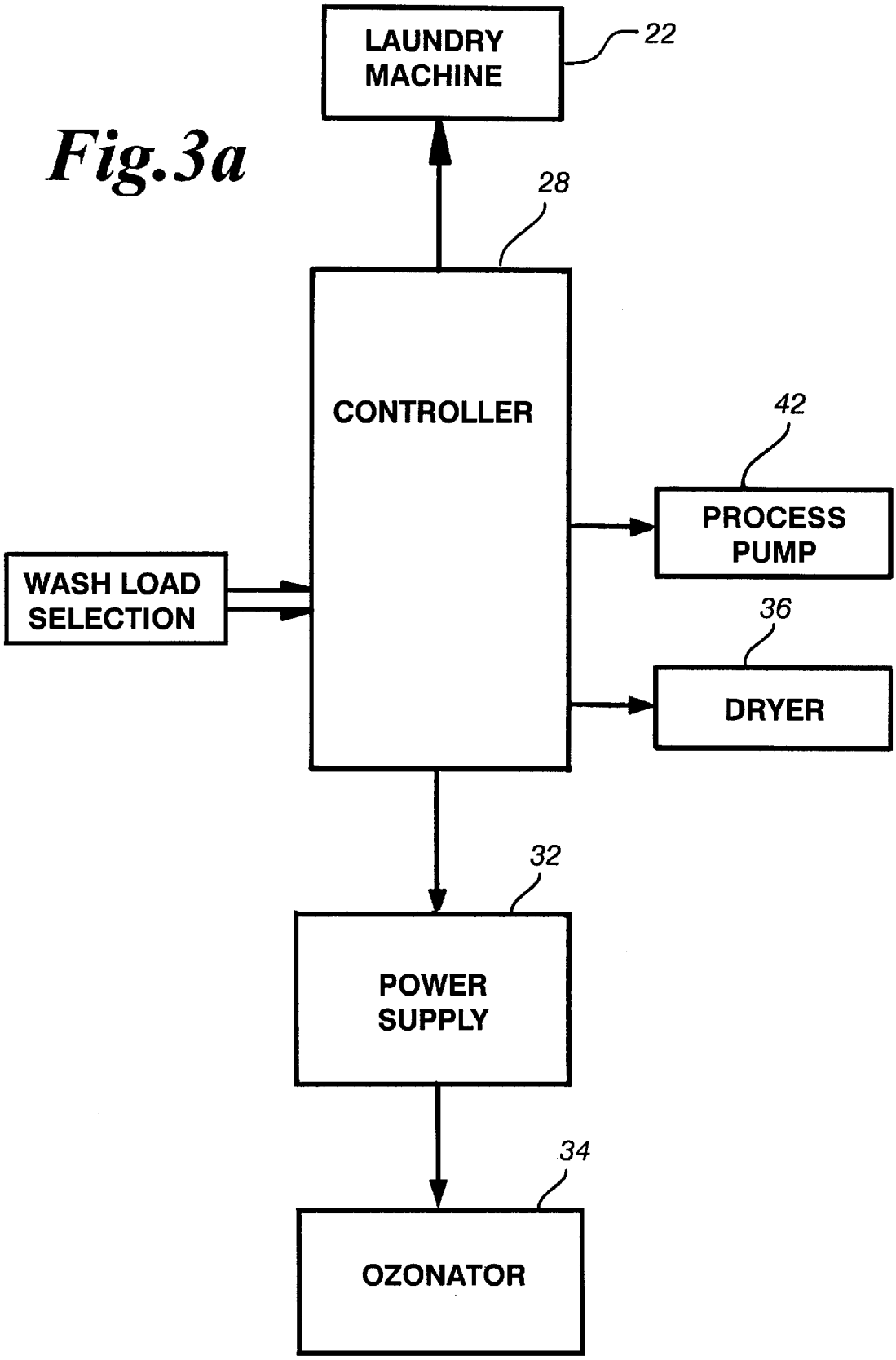
FIG. 3*a* is an electrical connection diagram illustrating a portion of the electrical signal paths required by the present invention.

FIG. 3*a* is an electrical connection diagram illustrating the electrical connections of a portion of the present invention. A load signal corresponding to the wash formula is transmitted to the controller 28. The controller 28 transmits a control signal to a variable power supply 32. Upon receiving the load-dependent control signal from the controller 28, the power supply 32 varies an output power level or potential. The output potential produced by the power supply 32 directly varies the amount of ozone produced by an ozonator 34. When activating the ozonator 34 while sending a control signal to the power supply 32, a dryer 36 is simultaneously activated by the controller 28 to dry the air to be ozonated. A process pump 42 draws wash liquor from the laundry machine when the controller 28 activates the process pump 42 in response to the load signal.

Figure 3B:
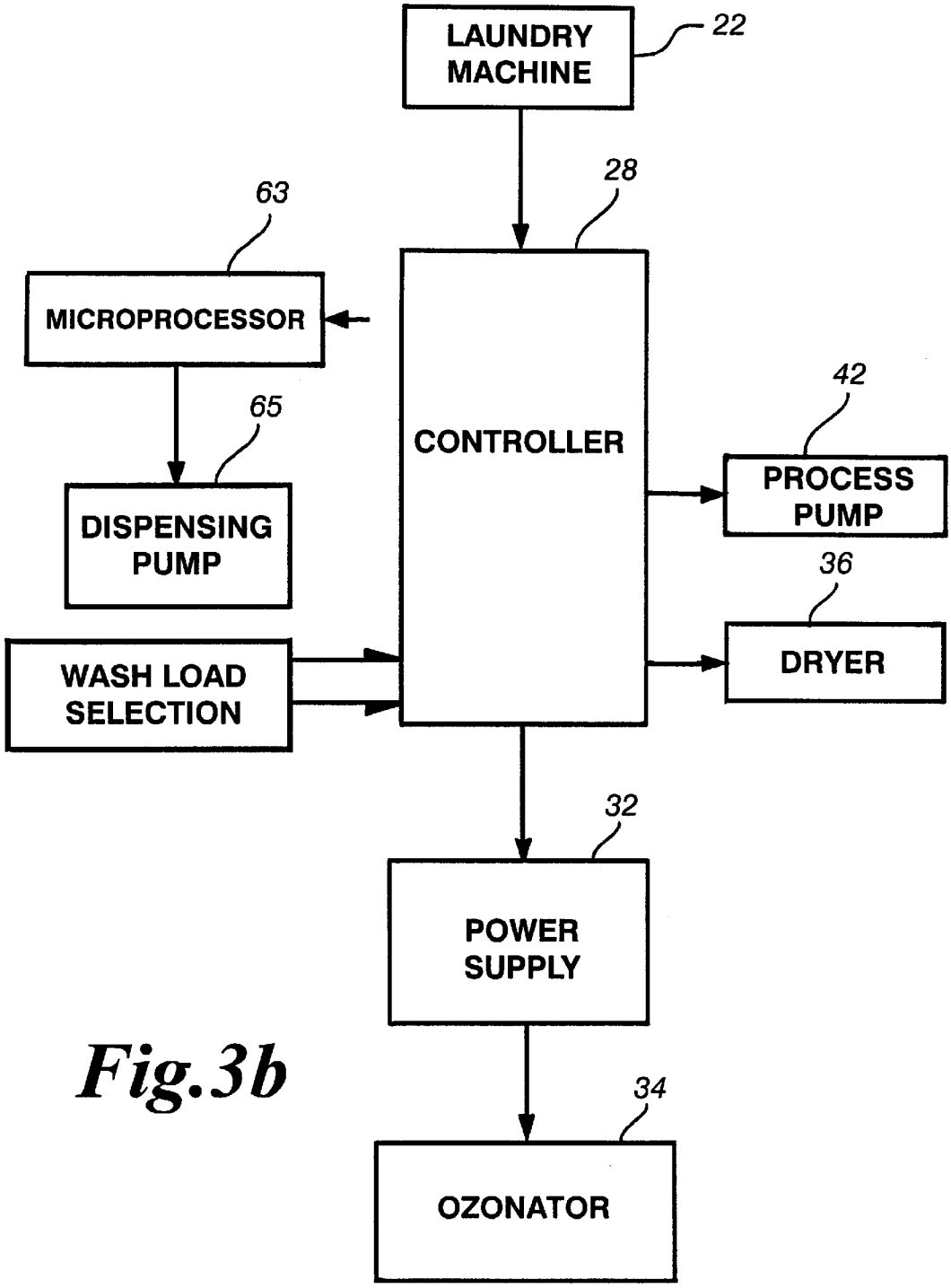
FIG. 3*b* is an electrical connection diagram illustrating an alternative embodiment of a portion of the electrical signal paths required by the present invention.

FIG. 3*b* is an electrical connection diagram illustrating an alternative embodiment of a portion of the electrical signal paths required by the present invention. The wash additive dispenser comprises a microprocessor 63 electrically communicating with the controller 28, a plurality of wash additive containers (not shown) and a dispensing pump 65 connected to the plurality of containers. The microprocessor 63 receives a dispensing signal from the controller 28. The microprocessor 63 then activates the dispensing pump 65 to dispense the wash additive into the wash liquor. As previously described, a load signal is transmitted to the controller 28. The controller 28 transmits a control signal to a variable power supply 32. Upon receiving the load-dependent control signal from the controller 28, the power supply 32 varies an output power level or potential. The output potential produced by the power supply 32 directly varies the amount of ozone produced by an ozonator 34. When activating the ozonator 34 while sending a control signal to the power supply 32, a dryer 36 is simultaneously activated by the controller 28 to dry the air to be ozonated. A process pump 42 draws wash liquor from the laundry machine when the controller 28 activates the process pump 42 in response to the load signal. Sensors (not shown) can be placed along the side-arm recirculation system to determine wash chemistry concentration and/or ozone entrained in the wash liquor. Data from the sensors can then be transmitted to the controller 28 which can, in turn, change the amount of wash additives to be dispensed by the dispensing pump 65 or the amount of ozone generated by the ozonator 34.

Figure 4:
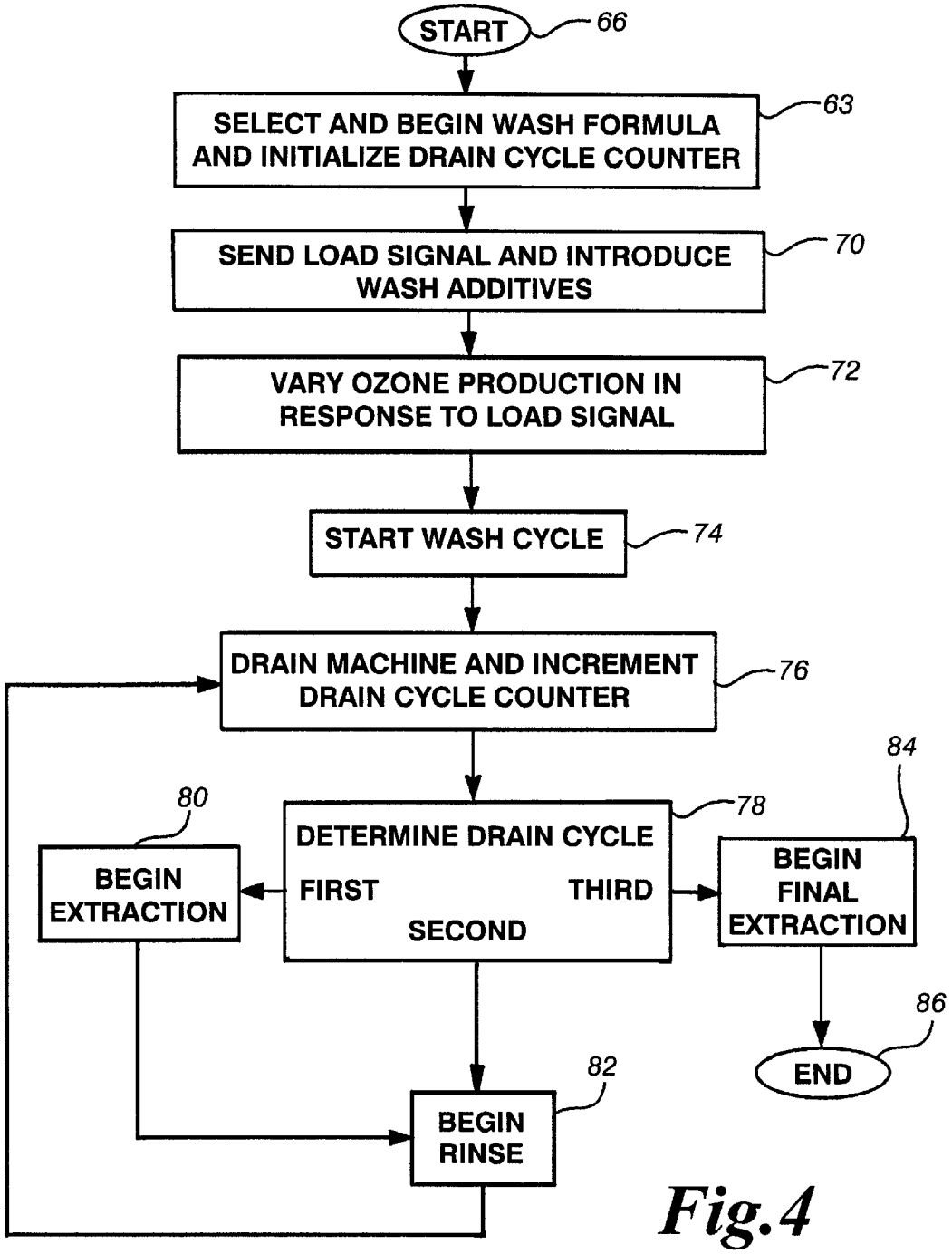
FIG. 4 is a flowchart of a method for treating laundry with ozone in accordance with the present invention.

FIG. 4 is a flowchart of a method for treating laundry with ozone in accordance the present invention. The method begins in step 66 when a wash load is selected. A user selects a load selection from a plurality of load selections corresponding to the laundry load type. The load selection begins a wash formula that corresponds to the inputted load selection at step 68. A drain cycle counter is initialized at step 68.

The wash load selection determines a load signal that is sent to the controller at step 70 in response to the wash formula. The pre-determined amount of each wash additive for the wash load selection and hot/cold water to fill the laundry machine, both determined by the wash formula, are also introduced to the laundry machine at step 70. A control signal, based on the load signal, is sent from the controller to the power supply at step 72. The output potential is sent from the power supply to the ozone generator at step 72 to produce ozone in response to the output potential. The air dryer is also activated/deactivated by the controller in response to the wash formula at step 72.

A wash cycle begins for the laundry machine at step 74. Wash liquor is drawn out of the laundry machine by a process pump and passed through a filter system at step 74 when the wash formula indicates to the controller to activate the process pump. The wash liquor passes the injector where ozone is entrained into the wash liquor at step 74. At the end of the wash cycle, the laundry machine is drained at step 76 and the drain cycle counter is incremented. At step 76, the control signal sent to the power supply by the controller then stops the ozone production.

The current drain cycle, based on the drain cycle counter, is determined at step 78 by the controller. If the drain cycle counter indicates a first cycle, the laundry machine proceeds to an extraction cycle at step 80 where the wash liquor is extracted from the laundry and preferably sent to the municipal sewage system. In an alternative embodiment of the present invention, the wash liquor is recycled for use in a closed-loop laundry treatment. After the wash liquor is extracted at step 80, the laundry machine proceeds to a rinse cycle at step 82.

If the drain cycle counter indicates a second cycle, the rinse cycle begins at step 82. Ozone may be entrained into the wash liquor during the rinse cycle 82 depending on the operation program. Furthermore, the amount of ozone entrained in the wash liquor during the rinse cycle can vary from the amount of ozone entrained in the wash liquor during the wash cycle. The wash formula indicates to the controller by the load signal whether ozone is to be produced for the particular load selection during the rinse cycle at step 82. When the wash formula indicates to the controller to produce ozone, the controller activates the pump, dryer and power supply in the manner described in steps 72 and 74. Additionally, wash additives may be introduced to the laundry machine as determined by the wash formula at step 82. Accordingly, the controller controls the amount of ozone entrained in the wash liquor during the rinse cycle as well as the wash cycle in response to the laundry load type. Further, the ozone entrained in the wash liquor during the rinse cycle is balanced with the wash chemistry in the wash liquor to conserve water consumption.

After the rinse cycle in step 82, the laundry machine drains again at step 76. If the drain cycle counter indicates a third cycle, the wash formula begins a final extraction at step 84 where the wash liquor is extracted from the laundry. The method ends at step 86. The ozone-enhanced chemistry of the wash liquor cleanses and disinfects laundry in a cost-effective manner. Additionally, by utilizing the ozone-enhanced chemistry of the present invention, water is conserved, energy required for heating water is reduced, and the amount of detergents, surfactants and disinfectants used is reduced.

FIG. 5 is a table showing an embodiment of a wash formula for treating laundry with ozone in accordance with the present invention. The wash formula indicates a specific step in the wash process by a step number 90. Each step 90 corresponds to one or more cycles 92 of the wash process. The cycles 92 include but are not limited to: a break or agitation cycle of laundry; a bleach dispense cycle; a drain of wash liquor from the laundry machine cycle; an intermediate extraction of wash liquor by spinning the laundry cycle; a rinse of laundry cycle; a sour addition cycle; and a final extraction of wash liquor by spinning the laundry cycle. Other cycles may be included and/or removed depending on the laundry load.

Each cycle 92 may introduce hot and/or cold water 94 to the laundry machine. The temperature of the water 94 is based on the particular laundry load. When each cycle 92 introduces water 94 to the laundry machine, a predetermined level 96 of water is introduced: Level 1 is a low water level; Level 2 is a medium water level; Level 3 is a high water level. Each cycle 92 is performed for a period of time 98, preferably measured in minutes. Each cycle 92 may dispense a specific wash additive or a plurality of wash additives 100 in response to the laundry load. The wash additives preferably include detergents (1), alkalines (2), bleaches (3) and sours (4), however, other wash additives may also be included.

SUMMARY OF THE ACHIEVEMENT OF THE OBJECTS OF THE INVENTION

From the foregoing detailed description, it is readily apparent that I have invented a system and method for treating laundry with ozone that controls the concentration of the ozone in a wash liquor. The present invention provides a system and method for treating laundry with ozone that varies the concentration of ozone entrained in the wash liquor in response to the wash load. The present invention also provides a system and method for treating laundry with ozone that varies the concentration of ozone entrained in the wash liquor in response to a particular cycle of the wash process. The present invention also provides a system and method for treating laundry with ozone that balances the concentration of ozone entrained in the wash liquor with the wash chemistry in the wash liquor. The present invention provides a system and method for treating laundry with ozone that determines and introduces an efficient amount of ozone and wash chemistry into the wash liquor in response to varying laundry loads to minimize ozone off-gasing, and to conserve water and energy.

It is to be understood that the foregoing description and specific embodiments are merely illustrative of the best mode of the invention and the principles thereof, and that various modifications and additions may be made to the apparatus by those skilled in the art, without departing from the spirit and scope of this invention, which is therefore understood to be limited only by the scope of the appended claims. In particular, the scope of the invention is not limited to a system and method for treating laundry with ozone which utilizes a commercial automated laundry installation or a conventional washing machine equipped with an automated detergent dispenser or otherwise adapted to accept a wash formula from a controller.

What is claimed is:

1. A system for treating laundry with ozone comprising:

a laundry machine having a selector for choosing a load selection;

a controller for receiving a load signal from the selector and for determining a control signal corresponding to the load selection;

an ozone generator electrically connected to the controller and adapted to receive the control signal for producing ozone in response to the control signal;

an air dryer receivably connected to said ozone generator by a shaft, said ozone generator ionizing the air from said air dryer thereby producing ozone;

an injector for receiving wash liquor from the laundry machine and ozone from the ozone generator and for entraining ozone into wash liquor, said injector having a discharge conduit for sending wash liquor and ozone to the laundry machine; and a pump connected to said laundry machine and said injector for drawing wash liquor out of the laundry machine and sending wash liquor to the injector;

wherein the ozone concentration entrained in the wash liquor is varied in response to the load selection.

2. The system according to claim 1 wherein the ozone generator comprises a variable power supply for receiving the control signal from the controller and for varying an output potential; and an ozonator electrically connected by the variable power supply for receiving air from said air dryer and for producing ozone in response to the output potential.

3. The system according to claim 2 wherein the output potential is varied by changing a load capacitance coupled to the power supply.

4. The system according to claim 2 wherein the output potential is varied by changing an amplification of the variable power supply.

5. The system according to claim 2 wherein the output potential is in the range of about 0 to about 220 volts a.c.

6. The system according to claim 1 further comprising a filter removably connected to the pump and the injector and adapted to receive wash liquor from the pump, said filter for removing particulates from the wash liquor and for passing wash liquor to the injector.

7. The system according to claim 1 further comprising a flow valve connected to said injector for maintaining a flow rate of the wash liquor leaving the injector.

8. The system according to claim 7 wherein the flow rate is about 10 standard cubic feet per hour.

9. A method for treating laundry with ozone having a laundry machine receiving wash liquor and having a selector for load selections, a controller, an ozone generator having a variable power supply and electronically connected to the controller, an injector connected to the ozone generator by a feed line, a filter removably connected to the pump and the injector and a pump connected to the laundry machine and the filter, the method comprising the steps of:

selecting a load selection on the selector from a plurality of load selections;

varying an ozone concentration provided to the injector by the ozone generator in response to the load selection;

drawing a wash liquor from the laundry machine by the pump;

filtering the wash liquor from the laundry machine through the filter, wherein the filtered wash liquor is sent to the injector;

entraining ozone from the ozone generator into the wash liquor received from the filter in the injector; and sending the wash liquor from the injector to the laundry machine;

wherein the ozone concentration entrained in the wash liquor is regulated by the controller in response to the load selection.

10. The method according to claim 9 wherein the step of varying an ozone concentration comprises the steps of:

determining a control signal in the controller corresponding to the laundry selection;

transmitting the control signal to the ozone generator from the controller; and varying a production of ozone by the ozone generator corresponding to the control signal.

11. The method according to claim 10 wherein the step of determining a control signal comprises the steps of:

receiving in the controller a load signal from the laundry machine; and creating a control signal in the controller based on the load signal.

12. The method according to claim 10 wherein the step of varying a production of ozone comprises the steps of:

varying an output potential of the variable power supply in response to the control signal from the controller;

sending the output potential to the ozone generator; and producing ozone corresponding to the output potential at the ozone generator.

13. The method according to claim 12 wherein the output potential is varied by changing a load capacitance coupled to the power supply.

14. The method according to claim 12 wherein the output potential is varied by changing an amplification of the variable power supply.

15. The method according to claim 12 wherein the output potential is varied from about 0 to about 220 volts ac.

16. The method according to claim 9 wherein the wash liquor is sent to the laundry machine from the injector at a flow rate of about 10 standard cubic feet per hour.

17. A system for treating laundry with ozone comprising:

a laundry machine having a plurality of laundry selections and a plurality of load signals corresponding to each of the laundry selections;

a controller for receiving one of the plurality of load signals from the laundry machine and determining a control signal based on the one of the plurality of load signals;

an ozone generator electronically connected to the controller for producing ozone responsive to the control signal;

a pump connected to the laundry machine for drawing a wash water from the laundry machine when activated by the controller; and an injector receivably connected to the ozone generator and the pump and connected to the laundry machine by a supply line for entraining ozone from the ozone generator into the wash liquor from the pump, wherein the wash liquor is sent to the laundry machine through the supply line;

wherein the ozone concentration entrained in the wash liquor is varied in response to the load selection.

18. The system according to claim 17 wherein the ozone generator comprises a variable power supply for receiving the control signal from the controller and for varying an output potential in response to the control signal; and an ozonator electrically connected by the variable power supply for producing ozone responsive to the output potential.

19. The system according to claim 18 wherein the output potential is varied by changing a load capacitance coupled to the power supply.

20. The system according to claim 18 wherein the output potential is varied by changing an amplification of the power supply.

* * * * *